US005785411A

United States Patent [19]

Komai et al.

[11] Patent Number: 5,785,411

[45] Date of Patent: Jul. 28, 1998

[54] TRACK LIGHTING SYSTEM

[75] Inventors: Neil M. Komai, Temple City; Thomas T. Nagano, Cerritos, both of Calif.

[73] Assignee: Tivoli Industries, Inc., Santa Ana, Calif.

[21] Appl. No.: 738,775

[22] Filed: Oct. 29, 1996

[51] Int. Cl.[6] ..... F21S 3/00

[52] U.S. Cl. ..... 362/219; 362/225; 362/226; 362/249; 439/110; 439/235

[58] Field of Search ..... 362/219, 220, 362/225, 226, 249; 439/110, 111, 235, 239, 698

[56] References Cited

U.S. PATENT DOCUMENTS

| | | | |
|---|---|---|---|
| 1,917,860 | 7/1933 | Wadsworth | 439/698 |
| 2,942,228 | 6/1960 | Swick | 439/698 |
| 4,655,520 | 4/1987 | Cummings . | |
| 4,979,081 | 12/1990 | Leach et al. . | |
| 5,260,859 | 11/1993 | Lettenmayer . | |

*Primary Examiner*—Thomas M. Sember
*Attorney, Agent, or Firm*—Price, Gess, & Ubell

[57] ABSTRACT

An improved track lighting system wherein a plurality of lamps are mechanically connected to a flexible track by metal connectors which also serve as the electrical connection for the lamps. The connectors include a stem which mounts along a central groove in the flexible track and have resiliently opposed arcuate members to releasably mount a conical or cylindrical end of the lamp. The electrical connection is achieved by a leg member which extends from the top of one of the arcuate members to the side of the track, where a foot member contacts an electric wire disposed within the side of the track. Each side of the track has a wire extending longitudinally along its length. When alternating connectors contact the two wires, an electric current can be generated through the lamp. The connectors can be selectively located anywhere along the track to place the lamp in a desire position, and the connectors are easily removed and replaced in the central groove. A junction box is located at the end of the track to provide the electrical load to the wires and protect the connections.

15 Claims, 2 Drawing Sheets

16
18
20
21
24
26
30
38
42
43
44
46
47
48
50
52
54
56
58
64
66
68
69

TRACK LIGHTING SYSTEM

BACKGROUND OF THE INVENTION

1. Field of the Invention

The invention relates generally to lighting systems and, more particularly, to a track lighting system whereby electrical and mechanical connections are achieved simultaneously to one or more lighting devices mounted to said system.

2. Description of Related Art

Systems of mounting lighting devices such that an electrical connection is achieved through such mounting is old in the art. See, for example, the system of Lettenmayer, U.S. Pat. No. 5,260,859. In Lettenmayer, tubular lamps are mounted by fixed lugs extending alternately from a right angle track with each leg of the track having a different polarity. The system utilized circular openings in the lugs to mount a tubular lamp therewithin, and the lugs further provided the current to energize the lamps. However, the lugs were fixed along the track and did not provide an adjustable connection, and therefore the use of different sized lamps are precluded. The shape of the track, along with the fixed lugs mounted to the track, led to other manufacturing problems which are avoided by the present invention.

It has been shown that an electrical distribution system can include a connection which is slidably adjustable along a length of track such that an illumination means can be positioned in multiple positions along the track, such as that of Cummings, U.S. Pat. No. 4,655,520. Cummings teaches a C-shaped channel with a guide shoulder on each external outer edge to provide a mounting means upon which a lamp can slide along. A flexible insulated cable is disposed within the channel and electrical contact is made along the channel by a connector having barb means.

Leach, U.S. Pat. No. 4,979,081, discloses an electrical system wherein a lamp with electrically conducting ends is mounted to a track having electrical conductors running longitudinally within channels formed by overturned edges. The mounting is accomplished by electrically conducting connectors each having two resiliently biased sides having first and second longitudinally extending edge portions of unequal lateral extent such that only one edge portion can contact a conductor.

Several disadvantages exist with prior art systems which are overcome by the present invention. For example, the system of Leach does not permit simple placement of the connectors for quick positioning of the bulbs, but rather requires connectors be slid longitudinally along said track. Furthermore, the electrical wires which serve as the conduit for a distant power supply are inconveniently disposed within the aforementioned channel, rendering them essentially inaccessible when the connectors and lighting device are in place. This can be especially problematic should contact between the wire and the connector become loose or disconnected resulting in a breach of the circuit. Furthermore, it is difficult to determine which electrical connection is being made when one or more lighting devices are in place, which may result in a connector being orientated incorrectly. Incorrect orientation presents a safety hazard and can damage the system.

OBJECTS AND SUMMARY OF THE INVENTION

The present invention addresses these problems and difficulties with a novel system which employs electrically conducting connectors mounted to an electrically insulating track along a central slot or groove. The connector comprises a two opposed arcuate members which are adapted to releasably mount an end of a bulb or lamp. The arcuate members are connected to a stem which mounts in the central groove of the track, and the connector also includes a leg member which assists in securing the connector to the track while providing the electrical contact to a cable disposed in the side of the track. The track is preferably an elongate flat member which may be simply manufactured by extrusion of an electrically insulating material such as plastic. The track comprises a central groove located longitudinally along the length of the track which is adapted to mate with a connector's stem. The track has along each side a channel which houses an electrical cable such that when a voltage is applied across both cables there exists an electrical potential which may support a current. A tubular lamp is placed between two connectors so that the arcuate members releasably grasp the conical ends of the lamp, and each connector is mounted to the track along the central groove. The connectors are orientated such that each connector's leg member is inserted into one of the side channels such that contact is achieved between the electrical cable and the leg member, and an electrical current is created between the two cables through the lamp, thereby energizing the lamp.

The present system provides several advantages over the prior art, such as distinctive orientation with regard to which electrical connection is being made, easy mounting and positioning of the connector anywhere along the track without deforming the connector, and visually accessible connection points from the cable to the connector. Moreover, the present system minimizes the possibility of a short circuit because the connectors are only connected to one of the two channels housing the electrical connections. The present invention is simple to manufacture and the connectors are less likely to deform or lose their resiliency because they are not required to be deformed in order to be positioned on the track. This leads to longer life of the connectors and a more cost efficient system.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to a track lighting system.

Figure 1:
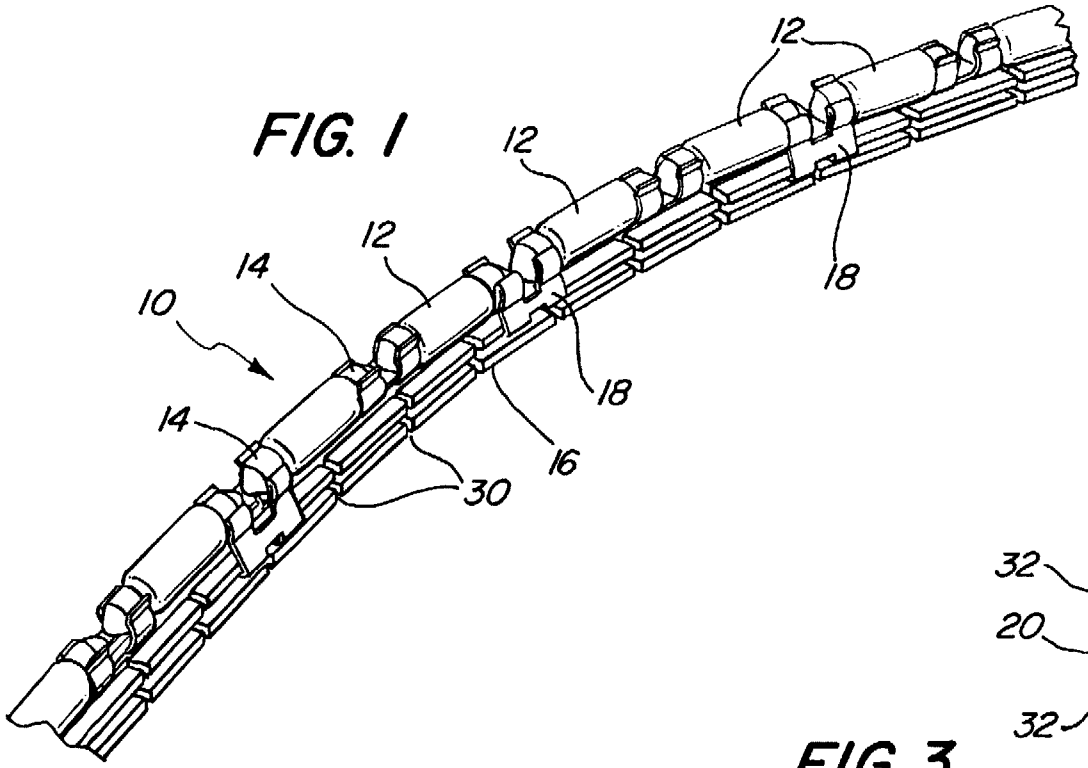
FIG. 1 is a perspective view of a preferred embodiment of the present invention.

The present invention is directed to a track lighting system 10 as illustrated generally in FIG. 1. In the embodiment shown, a series of tubular lamps 12 are connected in a linear end-to-end alignment along an elongated flexible track 16. The lamps 12 have conical or cylindrical electrically conducting terminal ends 14 which, when connected to an electric circuit, energize the lamp 12. Each lamp 12 is mounted to the elongate track 16 at its ends by insertable metal connectors 18. Each lamp 12 utilizes two connectors 18 to mount the lamp mechanically, and each connector 18 also serves as the electrical connection for the lamp 12. Along the side 28 of the track 16 are two channels 20, each of which house an electrically conductive cable or wire 22 such that the wire 22 is slightly exposed while secured in the channel 20. The connectors 18 are capable of mounting along the track 16 at adjustable positions along a central groove 24, and the connectors 18 include a leg member 26 which electrically connects the wire 22 with the connector 18. The preceding description demonstrates a connector for the lamp which achieves both a mechanical and electrical connection of the lamp 12, and which will be described more fully below.

The track 16 is typically a thermoplastic material which is electrically insulating and can be readily extruded to its desired shape. In one preferred embodiment, the track 16 comprises notches 30 along the side 28 in a spaced alignment to provide greater flexibility to the track 16 and allowing the track 16 to bend to follow lateral or radial bends (see FIG. 1). Such notches can be omitted in other embodiments.

Figure 2:
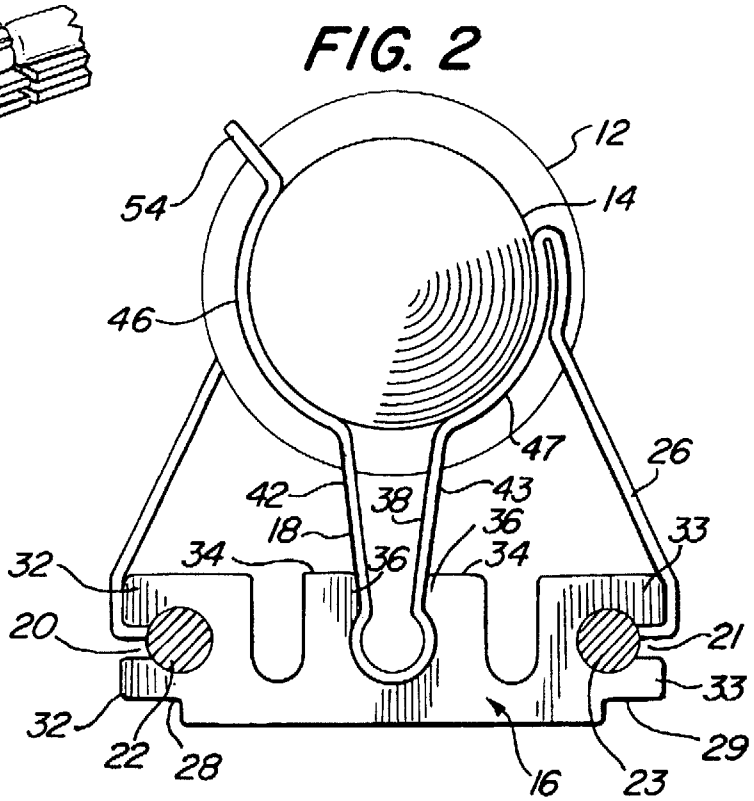
FIG. 2 is a profile view of the track and connector illustrating the central groove, the mating stem of the connector, and the channels housing the electrical connectors.

The track 16 utilizes a pair of laterally protruding fingers 32 spaced apart to define a channel 20, 21 on each side of the track 16. The pairs of fingers 32 extend longitudinally along the length of the track 16 to provide a housing for the electrically conducting wires 22, 23. FIG. 2 illustrates a cross-sectional view of the track illustrating the channels 20, 21, the wires 22, 23, the track 16, and a connector 18. In addition to the two pairs of spaced apart fingers 32, 33, the track 16 also comprises a groove 24 extending longitudinally along the upper surface of the track 16 and generally dividing the track into two halves. This central longitudinal groove 24, which extends the length of the track, is defined by a pair of spaced apart fins 34 extending perpendicular to the track and having opposed lips 36 at the free ends to narrow the groove 24 at the top. The two fins 34 and the opposed lips 36 form a groove 24 with a bulb-like profile adapted to secure a connector 18 therein while permitting a sliding movement of the connector 18 longitudinally within the groove 24.

The connector 18 is formed from an elongated thin metal conductor strip which is formed into the desired shape. The connector 18 is comprised of three integral sections, a stem 38, a resilient mouth 40 to receive the lamp 12, and a leg member 26 which is used to provide an electrical connection to the wire 22 and assist in securing the connector 18 to the track 16. The stem section 38 is formed by bending the metal strip into a U-shaped section with two generally parallel sides 42, 43 and a bottom section 44 having a slightly greater than 180-degree semicircular curve to yield a rounded, bulb-like lower section 44 whose maximum width exceeds the distance between the sides. The rounded lower section 44 is sized to fit snugly, i.e., "pop-fit" or "snap-fit" into the longitudinal groove 24 of the track 16 to secure the connector 18 to the track 16. The connector 18 can slide along the central groove 24, but the opposed lips 36 and the rounded lower section 44 of the connector 18 bias the connector 18 inside the groove 24 and inhibit the connector 18 from inadvertently becoming dislodged.

Figure 3:
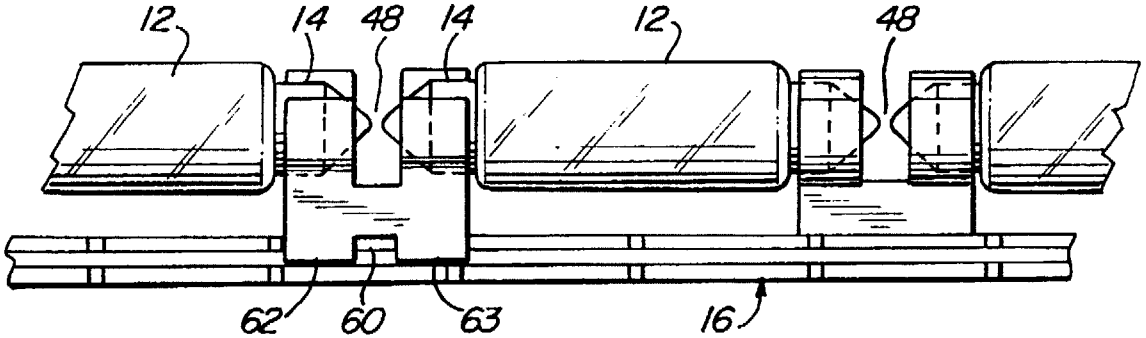
FIG. 3 is a side view of the track and connectors with a lamp disposed between the connectors.

At the upper edge of the two sides 42, 43 of the U-shaped stem section 38 of the connector and integral thereto are arcuate members 46, 47 which cooperate together to resiliently grasp and mount a conical end 14 of a lamp 12 therebetween. The arcuate members 46, 47 include a gap 48, as shown in FIG. 3, which separates the arcuate members 46, 47 into two independent pairs of jaw members 50, 52 where each pair of jaw members is designed to grasp one conical or cylindrical end of a different lamp 12 so that one connector 18 can support one end of two lamps. The gap 48 not only provides independence to the two pairs of jaw members 50, 52, but also reduces the amount of heat transferred to the connector 18. As the lamps 12 are exposed to the electrical current, large amounts of heat are generated and some of the heat is transferred to the adjacent connectors 18. The gap 48 reduces the heat transferred to the connector 18 and help reduce warping, heating the track, and other undesirable consequences of overheating the connectors.

Arcuate member 46 contains along a first upper edge a lip 54 which is used to assist in removing the connector 18 from the central groove 24 of the track 16 by prying the arcuate member 46 and side member 42 in the direction of the leg member 26 and helps in lamp installation. The prying action removes the connector by rotating the lower rounded section 44 from the central groove 24 and simultaneously disconnects the leg member 26 from the channel 20 to which it is connected.

Figures 4, 5, 6:
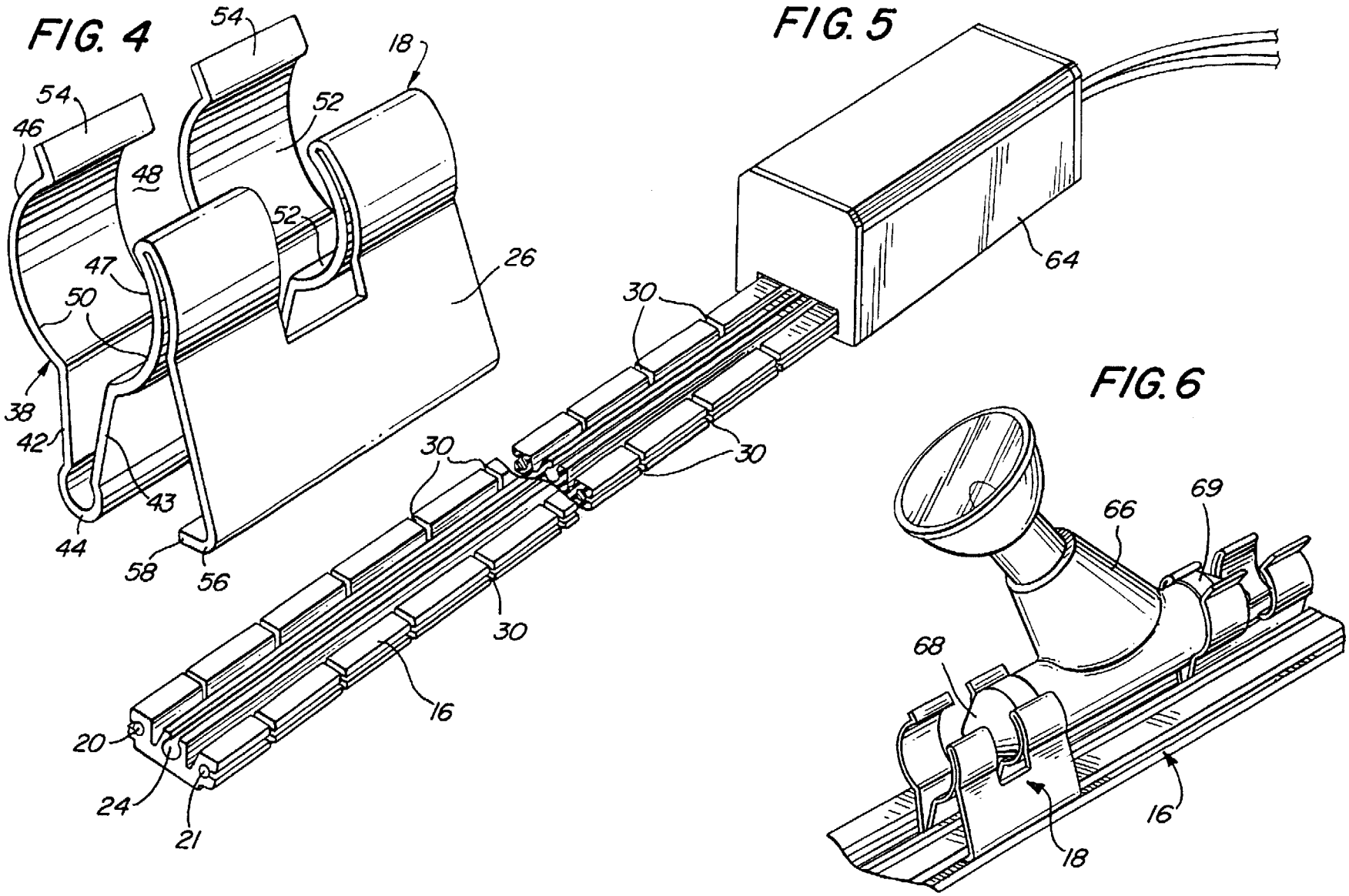
FIG. 4 is a perspective view of the connector of the present invention.
FIG. 5 is an elevated view of the junction box and electrical connections.
FIG. 6 is an elevated view of an alternate preferred embodiment.

As shown in FIGS. 2 and 4, the connector has a leg member section 26 which extends from an upper edge of the arcuate member 47 along the contour of the arcuate section and then extending to the side of the track 28, 29 where the channel 20, 21 is located. The leg member 26 terminates in a hooked section 56 with a foot 58 at the end which is inserted into the channel 20, 21 to ensure electrical contact with the wire 22, 23 and partially secure the connector 18 to the track 16. The leg member serves as the electrical conduit which communicates an electric current from the wire to the illumination device. Like the arcuate sections 46, 47, a second gap 60 divides the foot 58 into two smaller "leglets" 62, 63.

One embodiment as shown in FIG. 5 includes a junction box 64 attached to the track 16 at a first end. The junction box 64 houses the electrical terminals which produce the voltage differential across the two wires 22, 23 and which provides the electric load to generate the current in the lamps.

In addition to the type of lamp shown in FIG. 1, many other types of lamps may be used with the present invention. Referring to FIG. 6, an alternate illumination device 66 is shown with opposite extending electrically conducting ends 68, 69 which can mount in the connectors of the present invention. Illumination device 69 may also constitute a pop-fit insertable lamp having a spherical end with first and second conductive regions as taught in U.S. patent application Ser. No. 08/259,385, filed Jun. 14, 1994 and incorporated by reference herein.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. The improved lighting apparatus comprising:

an elongated track of electrically insulating material comprising a top surface, first and second side surfaces on respective sides of said top surface having laterally protruding fingers spaced apart and first and second channels formed, respectively, in said first and second side surfaces and extending longitudinally along said track, said elongated track further comprising a first longitudinal groove formed in said top surface between said first and second side surfaces and extending generally a length of said track along the top surface;

first and second electrically conductive members disposed within said first and second channels, respectively, and extending generally the length of said track; and at least a pair of connectors of generally identical construction, each said connector comprising an elongated sheet member comprising:

means insertable into said longitudinal groove for mounting said connector to said track along said longitudinal groove;

means for releasably securing an electrically conductive end of an illumination means; and means for communicating an electric current from one of said electrically conductive members to said end of said illumination means.

2. The apparatus of claim 1 wherein said means for mounting comprises a stem having a bulb-shaped end.

3. The improved apparatus as recited in claim 1 wherein said means for mounting said connector within said longitudinal groove comprises first and second sides spaced apart and integrally connected at a bottom edge by a rounded section, said first and second sides and said rounded section forming an elongated stem having means formed therein for mating with said first longitudinal groove of said track.

4. The improved apparatus as recited in claim 3 wherein said means for releasably securing a first end of said illumination device comprises a resilient mouth defined by first and second opposed convex members connected to and integral with said first and second sides, respectively, at their top edge, said opposed convex members adapted to receive said end of said illumination means therebetween and form an electrical contact thereat.

5. The improved apparatus as recited in claim 4 wherein said means for communicating an electric current from said electrically conductive members to said illumination device comprises a leg member integrally connected at a first end with said first convex member and adapted to selectively contact at a second end thereof one of the first and second electrically conductive members such that a first pair of connectors with each connector's resilient mouth securing one of the electrically conductive ends of said illumination means and each connector contacting a different conductive member define an electric circuit between said conductive members.

6. The improved apparatus as recited in claim 5 wherein said connectors further comprises a gap in said first and second convex members generally dividing said mouth into first and second mouths spaced apart by said gap, each of said first and second mouths adapted to independently receive and secure an electrically conductive end of a separate illumination means.

7. The improved apparatus as recited in claim 5 wherein said track further comprises a plurality of notch means in said first and second pairs of laterally protruding fingers and spaced apart longitudinally along said track for providing flexibility to said track whereby said track can be laterally flexed into a desired alignment.

8. The improved apparatus as recited in claim 5 further comprising a junction box mounted to said track, said junction box comprising a housing enclosure and terminal means for receiving an electrical load and transferring a voltage differential to said first and second electrically conductive members.

9. A track lighting system for mounting illumination devices of the type having an electrically conducting terminal at each end, said system comprising:

track means for slidably mounting at least one of said illumination devices thereon, said track means comprising an elongated, electrically insulating member having first and second sides each adapted to mount an electrically conducting cable in a partially enclosed channel, said channels opening generally in 180-degree opposite directions, said track means further comprising a groove extending generally the length of the track means on an upper surface and narrowing at a top of said groove;

first and second connector means for mounting one of said illumination devices at said first and second ends respectively on said track means in a continuously adjustable longitudinal position and providing an electrical connection to said illumination device from one of said electrically conducting cables, said connector means comprising:

a pair of spaced plates connected at first ends respectively by an integral semicircular member sized to mate with said groove of said track means and adapted to mount therein;

first and second opposing arcuate members integrally connected to said first and second plates respectively at ends opposite said semicircular member, said first and second opposing arcuate members cooperating to resiliently grasp one of said ends of said illumination device therebetween; and a leg member extending from said first arcuate member to one of said electrically conducting cables mounted in said track means to define an electrical contact thereto from one of said electrically conducting cables to said end of said illumination device whereby said first and second connector means contact with a different electrically conducting cable.

10. The track lighting system as recited in claim 9 wherein said first and second opposing arcuate members each includes a first gap extending from said plate to divide each opposing arcuate member into first and second adjacent jaw members to define first and second opposing jaws integrally connected by said first and second plates, said first and second opposing jaws adapted to independently each grasp one end of one of said illumination devices such that each connector is adapted to mount one end of two linearly aligned illumination devices.

11. The track lighting system as recited in claim 10 wherein said leg member comprises a second gap aligned with said first gap in said arcuate members and of generally a same width, said second gap extending from a juncture with said jaw members to generally a midpoint of said leg member to define first and second leglets each terminating in a curved foot member adapted to contact said electrically conducting cable and to secure said connector means to said track means.

12. The track lighting system as recited in claim 11 wherein each leglet comprises a first arcuate section adapted to follow the contour of the connected jaw member, and a generally straight member integral thereto and terminating in said curved foot member.

13. The track lighting system as recited in claim 12 wherein said leg member further comprises a third gap extending from said end terminating in said curved foot member to said generally straight member to divide said curved foot member into first and second feet.

14. The track lighting system as recited in claim 13 wherein said second pair of resilient jaw members each include a lip extending generally perpendicular thereto at an end opposite said connection with said second plate.

15. A unitary electrically conducting clip comprising:

a stem having first and second spaced apart sides integrally terminating in a curved bulb member having a maximum width greater than said spaced apart sides;

first and second opposed convex members integral with said first and second sides, respectively, to form a resilient mouth therebetween; and a leg member integral with one of said first and second opposed convex members having a convex section adjacent said integral opposed convex member, a generally straight section, and a foot member depending from said straight section with means for hooking to an adjacent mounting structure.

* * * * *